US005586541A

United States Patent [19]

Tsai

[11] Patent Number: 5,586,541

[45] Date of Patent: Dec. 24, 1996

[54] AUXILIARY ASSEMBLY FOR IMPROVING THE COMBUSTION EFFICIENCY OF AN ENGINE

[76] Inventor: Chun-Tie Tsai, P.O. Box 96-405, Taipei 10098, Taiwan

[21] Appl. No.: 512,126

[22] Filed: Aug. 7, 1995

[51] Int. Cl.[6] ..... F02M 25/06

[52] U.S. Cl. ..... 123/574

[58] Field of Search ..... 123/572, 573, 123/574; 137/907, 512.1, 512.2, 512.3, 533.1, 538

[56] References Cited

U.S. PATENT DOCUMENTS

| | | | |
|---|---|---|---|
| 3,437,082 | 4/1969 | Bouwkamp et al. | 123/574 |
| 3,463,132 | 8/1969 | Krieck | 123/574 |
| 3,548,867 | 12/1970 | Grisebach | 137/512.2 |
| 3,646,925 | 3/1972 | Eshelman | 123/574 |
| 3,659,573 | 5/1972 | Bennett | 123/574 |
| 3,880,130 | 4/1975 | Hecht | 123/574 |
| 4,291,660 | 9/1981 | Molyneaux | 123/574 |

*Primary Examiner*—Marguerite McMahon
*Attorney, Agent, or Firm*—Bacon & Thomas

[57] ABSTRACT

An auxiliary assembly for improving the combustion efficiency of an engine, mounted in the ventilation passage system of a crankcase. A body portion of the auxiliary assembly is furnished with two valves. When an engine is accelerating, the low pressure in the intake manifold will disappear opening a valve having a low-vacuum attraction for regulating the intake air flow. When the engine is in idle speed, normal running condition, or in an accelerating condition, the intake manifold will be in a low pressure condition, or in an instant super-low pressure condition. A valve having a high vacuum attraction is used for regulating the intake air flow so as to supply a suitable amount of fresh air to the intake manifold to dilute the over-rich mixture in order to improve the combustion efficiency of an engine.

10 Claims, 4 Drawing Sheets

AUXILIARY ASSEMBLY FOR IMPROVING THE COMBUSTION EFFICIENCY OF AN ENGINE

BACKGROUND OF THE INVENTION

1. Field of the Invention

This invention relates to a combustion device for an engine, and particularly to an auxiliary assembly for improving the combustion efficiency of an engine while running so as to provide a suitable amount of fresh air to dilute an over-rich mixture, 2. Description of the Prior Art When a conventional engine is running, an amount of air will run in the crankcase of the engine so as to scavenge the moisture and fuel gas in the crankcase under cold condition. The scavenging function has to be done by means of a system; otherwise, the crankcase will be accumulated with water and acid matter to choke the lubricant pipe, and to cause metal corrosion. The moisture and fuel gas should not be exhausted in the air directly because of air pollution. The crankcase is usually provided with a closed ventilation system, The air passing through the air cleaner is taken into the crankcase so as to scavenge the moisture and fuel gas through a conduit, the intake manifold, and into the cylinder before being burned.

During an engine idling, there is more air to be sucked into the intake manifold through the crankcase, i.e., the gas mixture will be diluted to cause abnormal running; in order to prevent such condition, the outlet of the crankcase has a crankcase ventilation valve to adjust the air volume.

In the prior art, a fuel-saving unit for the internal combustion engine, such as disclosed in Taiwan Patent NO. 80201784, is substantially a rotary unit mounted between the carburetor and the intake manifold. The rotary unit is a cylindrical part fixedly mounted on the intake pipe wall of the intake manifold; the upper part of the rotary unit has a hole for mounting a rotary blade assembly, a bush and a screw. Each blade is furnished with a plurality of oblique grooves. Before entering the intake manifold, the gas mixture is further atomized with the rotary unit so as to be burned completely in the combustion chamber for the purpose of saving fuel. Since such a unit is mounted between the carburetor and the intake manifold, some parts must be removed before installing the unit in place, aside from drilling hole on the intake manifold wall; in case of improper mounting, other parts will be damaged.

In U.S. Pat. No. 4,112,892, the fuel-saving unit is a whirling auxiliary unit mounted between the intake manifold and the crankcase ventilation pipe, but near the intake manifold, The auxiliary unit has an adjusting screw to adjust the air flow entering a whirlpool chamber; before the external air enters the intake manifold, the air will generate a whirlpool by means of a vacuum force provided with the intake manifold so as to have the external air completely mixed with the moisture and fuel gas left in the crankcase in order to obtain a complete combustion. In this invention, the screw is the only part to be used for adjusting the sectional area of the intake passage, i.e., merely further mixing the fuel gas scavenged from the crankcase ventilation system; when the vacuum force of the intake manifold is strong, the volume of the external air cannot be regulated automatically. If it is not adjusted properly, a high combustion rate under idle running will be caused.

In a prior art of Taiwan Patent NO. 79212774, the fuel-saving unit is an intake pipe mounted between the intake manifold and the carburetor; the intake pipe is loaded with a check valve and an air cleaner. An on-off valve is mounted between the check valve and the air cleaner. The check valve is to be opened and closed by means of a pressure of the engine upon running for regulating the flow of fresh air. Such a unit can have the fresh air flowing into the manifold to increase the mixing of the air and the gasoline; however, it is doubtful whether it can overcome the technical drawback of instant rich mixture or not upon an engine being accelerated and upon the throttle valve being opened widely. The specification of that invention never shows that point.

SUMMARY OF THE INVENTION

The prime object of the present invention is to provide an auxiliary assembly for improving the combustion efficiency of an engine.

Another object of the present invention is to provide an auxiliary assembly for improving the combustion efficiency of an engine; usually, when a car is accelerated, the instant opening and closing of the throttle valve would temporarily result in over-rich mixture; by using such an auxiliary assembly, a suitable amount of air can be provided to dilute the over-rich mixture so as to improve the combustion efficiency of an engine.

Still another object of the present invention is to provide an auxiliary assembly for supplying a suitable amount of fresh air through a valve to dilute the over-rich mixture upon the engine being in idle condition and under normal running condition so as to improve the combustion efficiency of an engine.

A further object of the present invention is to provide an auxiliary assembly for overcoming the problem of an over-rich mixture in the carburetor during the moment of an engine being accelerated and upon the throttle valve being closed to cause a super-low pressure in the intake manifold; such auxiliary assembly can, during the moment of the intake manifold having a super-low pressure, increase the air flow dimension of the valve so as to supply sufficient air to the intake manifold for diluting the over-rich mixture.

A feature of the present invention is that the auxiliary assembly includes two valves for regulating the intake air before being connected to one intake passage to an intake manifold. During engine acceleration, a vacuum attraction will be varied and the opening dimension of the valve will also be adjusted timely so as to have fresh air enter the intake manifold to dilute the over-rich mixture and to improve the combustion efficiency of an engine.

Another feature of the present invention is that one of the two valves in the auxiliary assembly is used for supplying a suitable amount of air flow dimension upon the intake manifold under a high vacuum attraction; in the valve, a spring with a high elastic modulus pushes against the valve body toward the valve seat thereof. When the intake manifold of an engine is under a high vacuum, the other valve with a lower elastic modulus will be closed as a result of the high vacuum; then, the valve with a high elastic modulus is used for controlling the air flow dimension so as to supply a suitable amount of fresh air to the intake manifold and to dilute the over-rich mixture in order to improve the combustion efficiency of an engine.

Another feature of the auxiliary assembly of the present invention is that the two valves in the auxiliary assembly are mounted in one body portion and arranged in one passage; one of the two valves is mounted inside the valve body of the other valve; when the low pressure in the intake manifold disappears, the valve in the valve body is used for controlling the air flow dimension because of the spring to control the valve having a low elastic modulus so as to supply a suitable amount of air to dilute (or to lean out), the over-rich mixture upon the accelerating moment. When the intake manifold restores to a low pressure condition, the valve controlled with a spring having a low elastic modulus will be closed; then, the valve controlled with a spring having a high elastic modulus will be used for regulating the air flow dimension to dilute the over-rich mixture.

Still another feature of the auxiliary assembly of the present invention is that the two valves in the auxiliary assembly are mounted in two different passages in one body portion, and then the two passages are connected with the intake manifold through one passage. The two valve bodies of the two valves are controlled with two springs having different elastic modulus; when the intake manifold of an engine has no low pressure upon acceleration, and restores to a low pressure condition, and to a super-low pressure after acceleration upon the throttle being opened, the valve springs and valve bodies are used for controlling the air flow dimension respectively so as to regulate the intake air.

A further feature of the auxiliary assembly of the present invention is that the intake end of the body portion in the auxiliary assembly is mounted with a filter, which can purify the dust and impurities in the air so as to let a fresh air flow into the engine.

DETAILED DESCRIPTION OF THE PREFERRED EMBODIMENT

Figure 1:
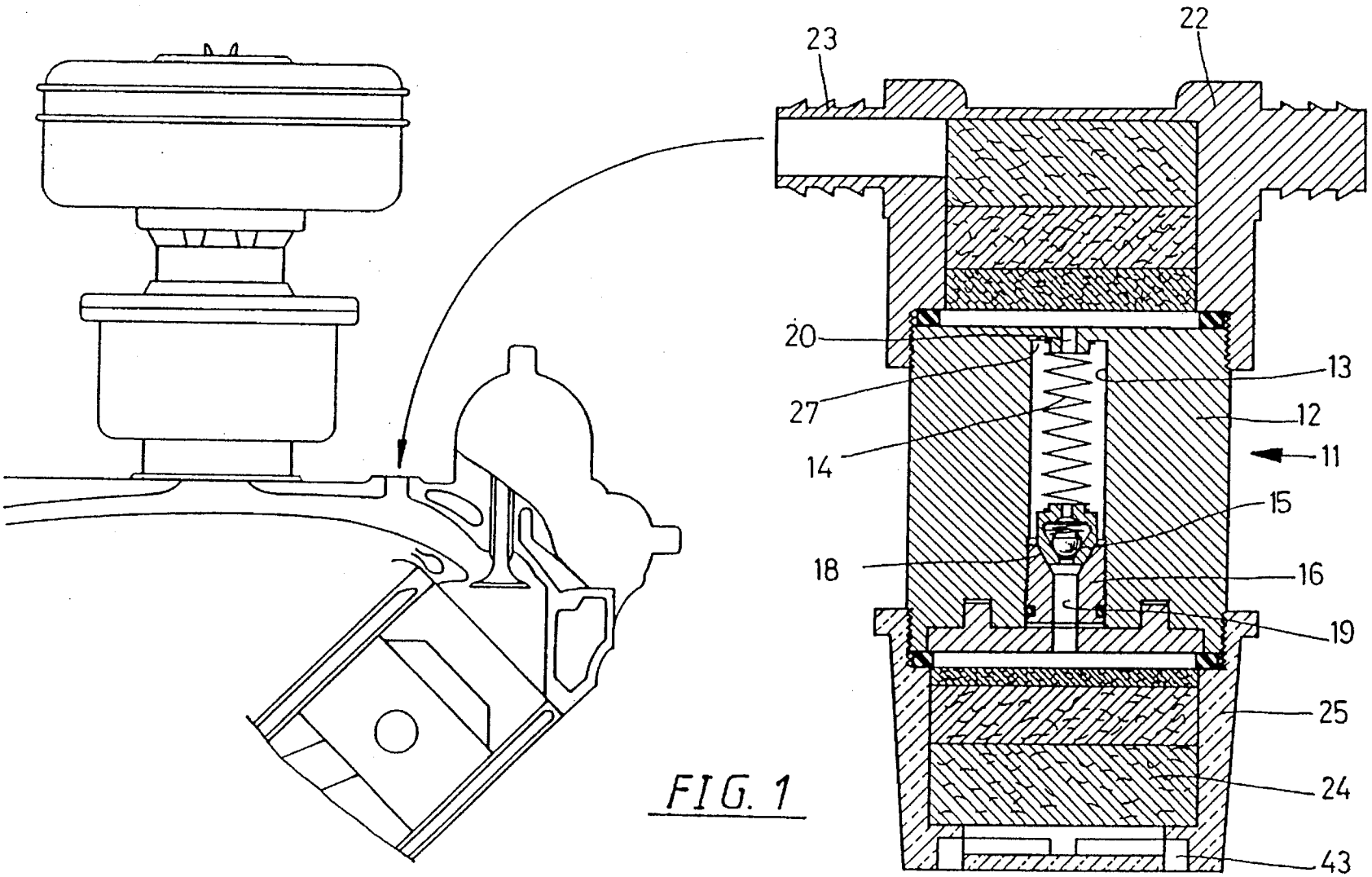
FIG. 1 is a sectional view of the present invention, showing the connection relation with the intake manifold of an engine.

The present invention is an auxiliary assembly for improving the combustion efficiency of an engine; as shown in FIG. 1, the auxiliary assembly 11 has a connecting nozzle 23 to be connected to the ventilation passage system of the crankcase by means of a conduit. The auxiliary assembly 11 can duly provide a fresh air upon the engine running and accelerating to vary the vacuum attraction in order to dilute the rich mixture and to improve the combustion efficiency of an engine.

Figure 7:
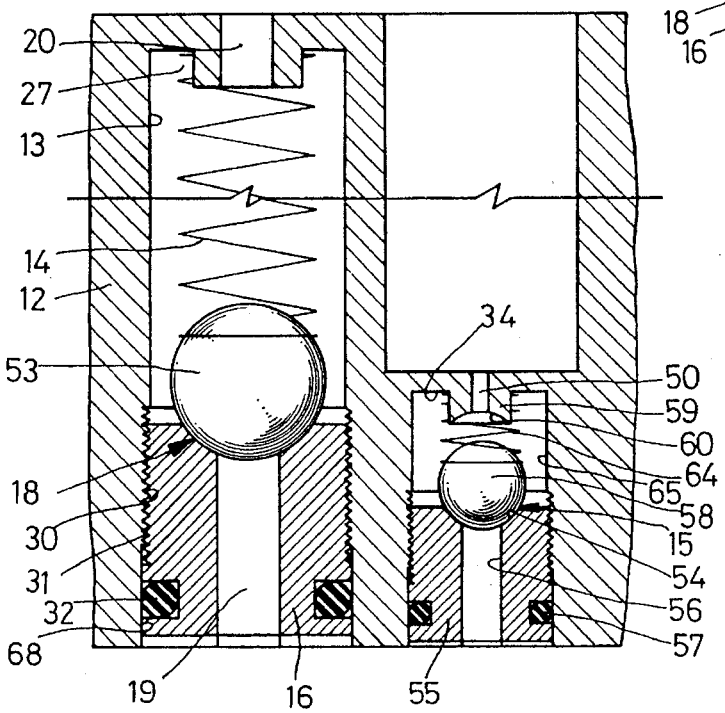
FIG. 7 is a fragmental section view of the present invention, showing another embodiment of the two valve assemblies mounted in another body portion.
Figure 8:
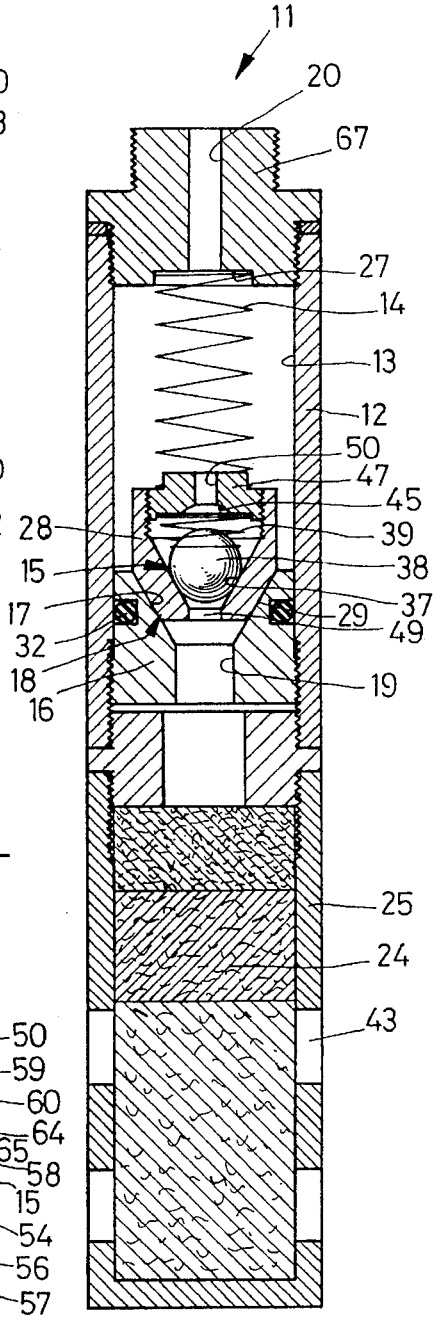
FIG. 8 is a sectional view of the present invention, showing the two valve assemblies mounted in two different passages.
Figure 9:
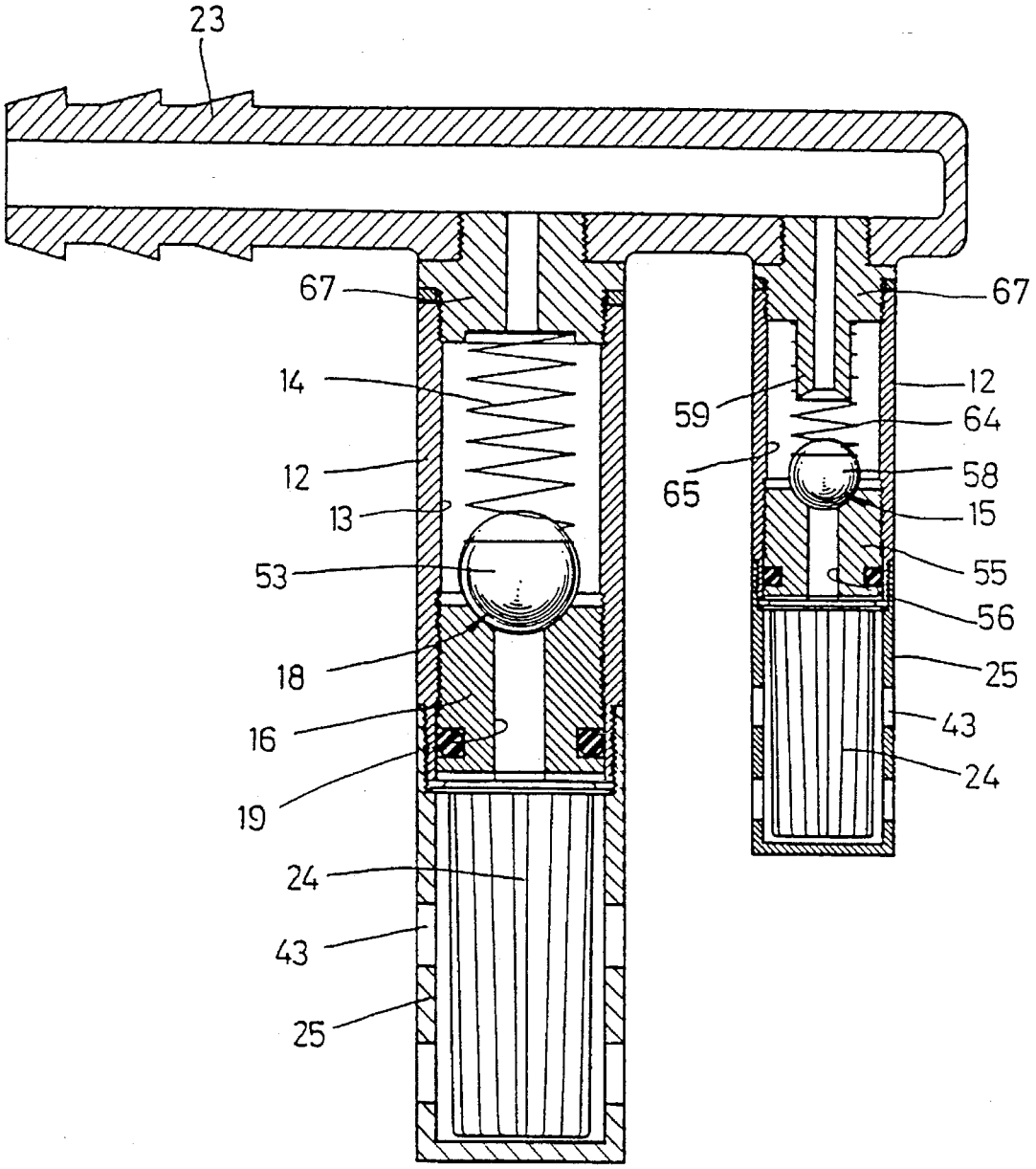
FIG. 9 is a sectional view of the present invention, showing the two valve assemblies mounted in two different body portions.

Referring to FIGS. 1 or 7 and 9, the outlet of the through hole 20 of the auxiliary assembly 11 is connected with the intake manifold of the engine with a proper means. As shown in FIG. 1, the connecting cap 22 of the auxiliary assembly 11 is connected with one end of the body portion 12, and then the connecting nozzle 23 is connected with the outer pipe of the intake manifold. As shown in FIGS. 8 and 9, the top end of the body portion 12 of the auxiliary assembly 11 is connected with a connecting terminal 67 through threads; the connecting terminal 67 is then connected with the intake manifold of an engine or a suitable conduit. The inside of the auxiliary assembly 11 is mounted with two valves 15 and 18, which enable a suitable amount of fresh air to enter the intake manifold upon the vacuum attraction varying during an engine being accelerated. The other end of the body portion 12 is mounted with a casing member 25 loaded with a filter 24; air can flow into an intake passage 43 of the casing member 25, and then through the filter 24 to screen all impurities, and through the valves 15 and 18 under different vacuum attraction so as to let a suitable amount of air enter the inlet of the intake manifold via a connecting pipe.

The valve 15 provides a suitable amount of air upon a low pressure in the intake manifold so as to dilute a rich mixture during acceleration. The valve 18 (a low pressure valve) is used for supplying a suitable amount of air upon low pressure in the manifold, and for supplying a suitable amount of air during the super-low pressure on the instant of throttle opening so as to dilute the rich mixture for increasing the combustion efficiency of an engine.

The auxiliary assembly 11 has a center hole 13 in the body portion 12 as shown in FIGS. 1 to 5, 7 and 9. The intake end of the center hole 13 in the body portion 12 is furnished with inner threads 30 and a cylindrical surface 68 so as to facilitate the outer threads 31 on the valve seat 16 to engage with inner threads 30; by means of an O-ring 32, the valve seat 16 can be fitted together closely with one end of the center hole 13. The center of the valve seat 16 has an intake passage 19; the outer end of the passage has a groove 26; the inner end of the intake passage 19 has a conic surface 17. The groove 26 is used for adjusting the position of the valve seat 16 by means of a screw driver. The intake passage 19 is used for supplying a suitable amount of air passing through the filter 24 under the variation of the vacuum attraction of the two valve assemblies. The conic surface 17 of the valve seat 16 is to be in close contact with a valve surface 29 of the valve body 28 of valve 18; when the two surfaces are separated each other, the air flow will be changed.

The two valves 15 and 18 are mounted in the center hole 13 of the body portion 12; the valve 15 is substantially fitted in the valve body 28 of the valve 18. The valve 15 includes a valve body 28, a valve ball 38, a valve seat 47 and a spring 39; the inside of the valve body 28 has a conic surface 37; the lower end of the conic surface 37 has an intake hole 49, while the other end thereof has inner threads 36. The space between the conic surface 37 is loaded with the valve ball 38 and the spring 39. The outer end of the valve body is mounted with a valve seat 47 by means of threads. The valve ball 38 on the conic surface 37 in the valve body 28 is positioned with a conical spring so as to be maintained in close contact with the conic surface 37. The spring 39 is substantially a conical spring with a pre-determined elastic modulus; one end of the spring has a smaller diameter pushing against the valve ball 38, while the other end thereof has a larger diameter pushing against the top surface 34 of the valve seat 47; the valve ball 38 is normally pushed against the conic surface 37 as a result of the pushing force of spring 39. The valve seat 47 is mounted on the opening of the valve body 28 by means of the outer threads 48 thereof and the inner threads 36 in the valve body; the outer end of the valve seat is furnished with a positioning stud 69 to be pushed with a spring 14. The center of the valve seat 47 has a through hole 50; the inner end of the through hole 50 has a ball seat 45, of which the curvature is to be designed in accordance with the diameter of the valve ball 38. To assemble the valve 15, the valve ball 38 and the spring 39 have to be put in the conic surface 37 of the valve body 28, and then the valve seat 47 is mounted to the open end of the valve body 28 by means of the outer threads 48; then, the whole valve will be tested with a vacuum attraction testing instrument in a laboratory to test its air flow capacity desired by adjusting the space between the valve seat 47 and the valve body 28 with threads engaged; as soon as the adjustment is done, the threads between them will be fixed by means of a glue.

Figure 2:
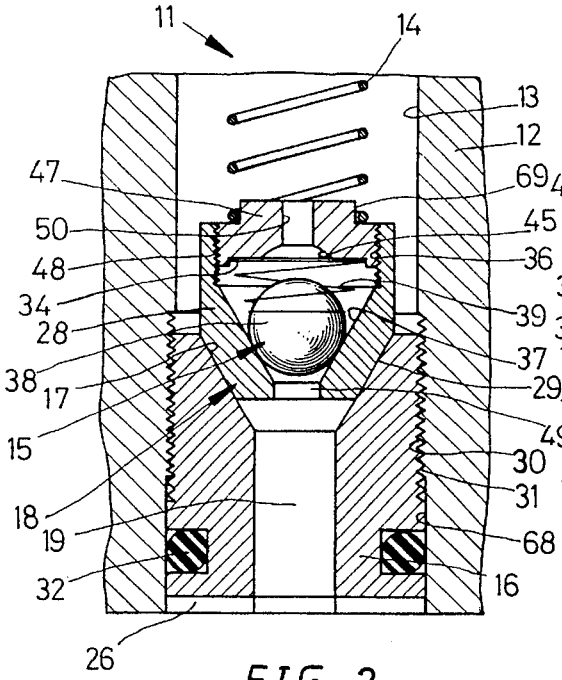
FIG. 2 is a fragmental section view of the present invention, showing two valve assemblies fitted in one passage.
Figure 6:
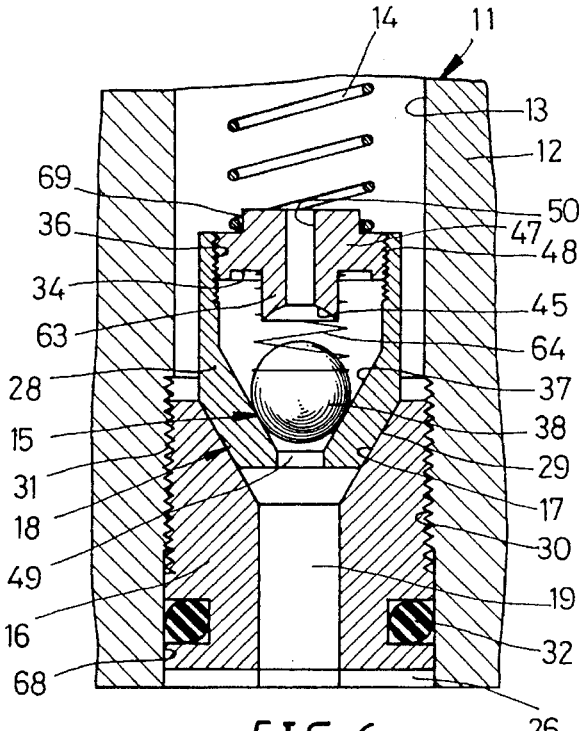
FIG. 6 is a fragmental section view of the present invention, showing another embodiment of the ball seat structure of the valve.

The lower end of the through hole 50 in the valve seat 47 has a ball seat 45, as shown in FIG. 2, in the center of the top surface 34. As shown in FIG. 6, the lower end of the valve seat 47 is furnished with a stud valve seat 63 extended in the valve ball 38 direction, and the end of the stud valve seat 63 has a ball seat 45. The outer surface of the stud valve seat 63 is mounted with a spring (cylindrical-shaped one) 64, and one end of the spring 64 is pushed against the top surface 34, while the other end thereof is in contact with the ball valve 38. When the valve ball 38 pushed by the spring 64 is affected with a low vacuum attraction of the intake manifold, the air flow dimension in the space between the valve ball 38 and conic surface 37 of the valve body 28 will change to let a suitable amount of air pass. If the vacuum attraction of the intake manifold is higher than a preset valve, the valve ball 38 will be pulled to the ball seat 45 on the stud valve seat 63, i.e., to block air to pass through the valve 15; instead, the air will pass through another valve 18 to enter the intake manifold.

Figure 3:
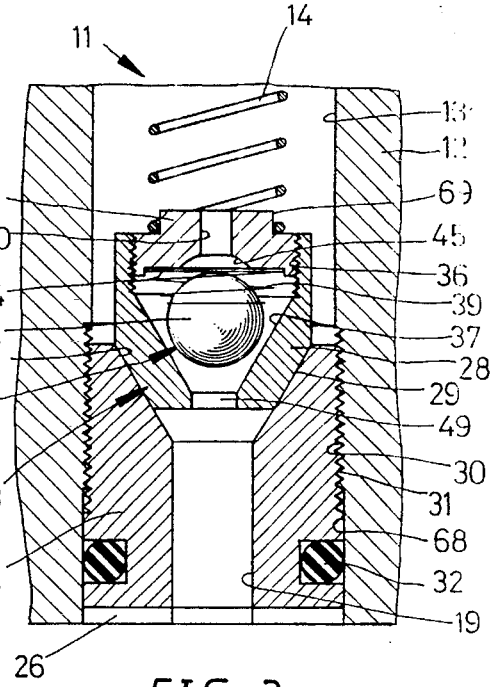
FIG. 3 is a fragmental section view of the present invention, showing the valve operation under a low vacuum attraction condition of the intake manifold.
Figure 4:
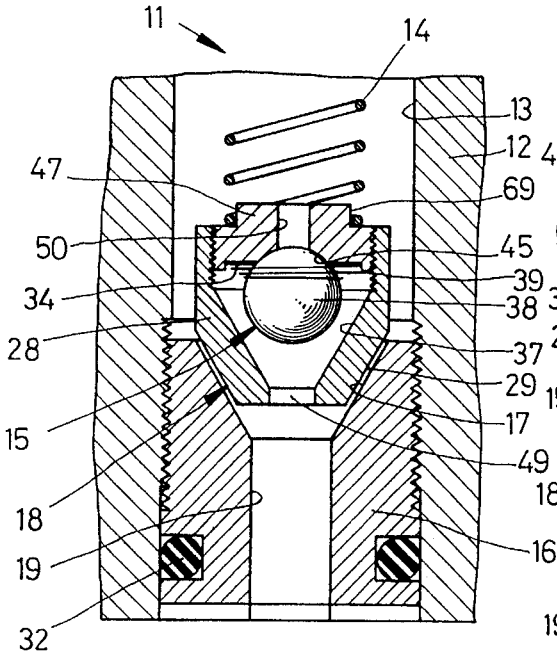
FIG. 4 is a fragmental section view of the present invention, showing the valve operation under a higher vacuum attraction conditon of the intake manifold.

Referring to FIGS. 2 to 4, when testing the air flow capacity of the valve 15, set the mercury column of the vacuum attraction tester at a height ranging from 10 to 15 centimeters in advance; such height may be varied from different car models. To test valve 15, let the positioning stud 69 of the valve seat 47 connect with the testing socket of the vacuum attraction tester during the test, the valve 15 will let a suitable amount of air pass through the space between the conic surface 37 and the valve ball 38 to push the spring 39 until the valve is opened (as shown in FIG. 3). When the valve ball 38 is being pulled upwards to press the spring 39, the air flow dimension between the valve ball 38 and the conic surface 37 will change; if the spring 39 is not adjusted to the best value condition, a desired air flow will not be obtained. The air flow dimension between the valve ball 38 and the conic surface 37 can be adjusted in accordance with F=KX theory so as to obtain a standard value. If the air flow is too high or low, adjust the thread-engaged portion between the valve body 28 and the valve seat 47 until the spring 39 being set and pressed at the best distance so as to have the air flow passed at a preset value; then, adjust the vacuum attraction to have the mercury column at about 30 centimeters high, and see if the valve ball 38 is in close contact with the ball seat 45 (as shown in FIG. 4) of the valve seat 47 upon the valve ball being attracted by the vacuum attraction, i.e., no air passing through. After the valve 15 is tested, the thread portion between the valve body 28 and the valve seat 47 will be fixed together by means of a glue. After the valve 15 is tested and mounted in the valve 18, an amount of air entering the intake manifold will be controlled with the valve 15 on condition that the intake manifold generates a vacuum having the height of the mercury column below 30 centimeters. If the vacuum attraction of the intake manifold of an engine is higher than 30 centimeters of mercury, the valve 15 will be closed automatically; simultaneously, the air will flow into the intake manifold through the valve 18.

The valve 18 mounted in the center hole 13 of the body portion 12 includes a valve seat 16, a valve body 28, and a spring 14. The center hole 13 has an opening in the intake end, and a cylindrical portion therein, and has an inner thread 30 section and a cylindrical surface 68. The other end of the center hole 13 has a top side 27, being pushed against with the spring 14. The upper end center of the body portion has a through hole 20. The inner threads 30 of the center hole 13 can be engaged with the outer threads 31 of the valve seat 16; both of them can be in close contact by means of an O-ring 32 on the valve seat 16. The center of the valve seat has an intake passage 19 with a conic surface 17. The lower outer end of the valve body 28 has a valve surface 29, which is used for regulating the air flow upon a vacuum attraction being applied thereto; the outer surface of the valve body 28 is formed into a cylindrical shape, while the lower outer end thereof that is opposite to the conic surface 17 has a valve surface 29 of conic and a semi-spheric surface. The other end center of the valve body 28 has a positioning stud 69 to be pushed against with one end of the spring 14 so as to push the valve body 28 normally towards the conic surface 17 of the valve seat 16. The valve body 28 is mounted between the valve seat 16 and the spring 14. The valve surface 29 is in a round shape to be in close contact with the conic surface 17. Normally, the valve body 28 is pushed against with the spring 14 with a given force; as soon as the engine is started and the intake manifold thereof generates a higher vacuum attraction to cause the mercury column over 30 centimeters, the valve body 28 will move to change the space between the valve surface 29 and the conic surface 17, and then the air flow dimension will also be changed to have a suitable amount of air enter the intake manifold.

Before a valve 18 is fitted into the center hole 13 of the body portion 12, select a valve body 28 already tested (loaded with a valve 15); the valve body 28 and the spring 14 are mounted in the center hole 13 respectively; the two ends of the spring 14 are positioned against the top side 27 and the positioning stud 69 of the valve body 28 respectively; then, the valve seat 16 is mounted to the inner threads 30 in the open end of the center hole 13; the valve seat 16 and the threads of the body portion 12 are in close contact each other with the O-ring 32 so as to let air enter the intake passage 19 of the valve seat 16 directly. After the valve 18 is mounted in place, the pushing force of the spring 14 to the valve ball 38 of the valve 15 can be adjusted by means of changing the thread position there between.

The space variation between the valve surface 29 of the valve body 28 and the conic surface 17 of the valve seat 16 is hinged on the variation of the vacuum attraction of an engine. When the vacuum attraction of the intake manifold is less than 30 centimeters of the height of the mercury columns the valve 18 will not move because of being controlled with the elastic modulus of spring 14; instead, the valve 15 in the valve body 28 will supply a suitable amount of air to the intake manifold. When the vacuum attraction of the engine is higher than 30 centimeters of the height of the mercury columns the valve ball 38 of the valve 15 will be pulled to be in close contact with the ball seat 45 of the valve seat 47 to close the air passage; instead, the valve 18 will be opened to supply a suitable amount of air to the intake manifold. The valve body 28 of valve 18 is pushed against by the spring 14, which is a counter force to the vacuum attraction; such counter force can normally push the valve surface 29 of the valve body 28 into contact with the conic surface 17 of the valve seat 16 when the vacuum attraction is reduced.

The extent of becoming close contact between the valve surface 29 of the valve body 28 and the conic surface 17 of the valve seat 16 is hinged on the preset elastic modulus of the spring 14. A uniform pushing force to the valve body 28 from the spring 14 can be obtained by adjustment. After the spring 14, the valve body 28 and the valve seat 16 are fitted in the center hole 13 of the body portion 12, the valve 18 should be tested through an air flow tester. During such test, the vacuum attraction tester should be set with the mercury column thereof at a height of ranging from 40 to 45 centimeters; the height of the mercury column is to be set varibly in accordance with the difference of car models. The connecting nozzle 23 of the body portion 12 is connected to the intake manifold; under the attraction of the vacuum attraction tester, only valve 15 of two valves is in closed condition, i.e., a suitable amount of air will be supplied via a passage between the valve surface 29 of the valve body 28 and the conic surface 17 of the valve seat 16. When the valve body 28 is pulled by the vacuum attraction to press the spring 14, the air flow dimension between the valve surface 29 of the valve body 28 and the conic surface 17 will be changed in terms of supplying a suitable amount of air therefrom. If the spring 14 is not adjusted to the best condition, the desired air flow desired will be unobtainable; in other words, the valve seat 16 should be adjusted to a correct position so as to have the spring 14 generate a preset pressure. If the air flow is too high or low, the position of the valve seat 16 has to be adjusted in order to have the spring 14 a desired compression distance, and let the air flow reach a desired valve. After the valve 15 is tested, the contact surface between the outer end of the valve seat 16 and the center hole 13 will be sealed and fixed with a glue so as to have the valve seat 16 fixed to the opening of the center hole 13.

Referring to FIG. 7, another embodiment of the auxiliary assembly 11 according to the present invention comprises two valves 15 and 18, which are fitted in two different center holes 65 and 13 within one body portion 12. Before assembling the valves, both of them have to tested and calibrated with a tester; the theory, purpose and function of the two valves are the same as that of the previous embodiment. The valve 18 is mounted in the center hole 13 of the body portion 12; the center hole 13 is loaded with a spring 14 and a valve ball 53. The spring 14 is set to maintain a pushing force against the valve ball 53 so as to push the valve ball to sit on the ball seat of the valve seat 16. The center of the valve seat 16 has an intake passage 19 with a ball seat. The valve ball 53 and the ball seat are in close contact as a result of the pushing force of the spring 14. The valve 15 is also mounted in the body portion 12. The end of the center hob 65 is furnished with inner threads and a cylindrical surface to facilitate a valve seat 55 fastened therein. Before the valve seat 55 being mounted in place with threads, a bah seat 60 under a through hole 50 is loaded with a spring 64 (cylinder-shaped) mounted on a stud valve seat 59 and a valve ball 58; the spring is used for pushing the valve ball 58 to be in close contact with the ball seat 54. The valve seat 55 is screwed inside the inner threads of the center hob 45; the center of the valve seat 55 has an intake passage 56 with a ball seat 54 on inner end thereof; the ball seat 54 is used for mounting the valve ball 58 to be pushed with a spring 64 having a preset elastic modulus so as to have the valve ball 58 contacted closely with the ball seat 54 of the valve seat 55. As soon as the intake manifold generates a vacuum attraction, the air flow dimension between the valve ball 58 and the ball seat 54 will be adjusted properly by means of the spring 64 and the vacuum attraction.

As soon as the vacuum attraction is higher than a preset value, the valve ball 58 will be sucked to attach to the ball seat 60 of the stud valve seat 59 closely. When the valve 15 is closed, the high vacuum attraction will be applied to the valve ball 53 of the valve 18 so as to supply a given amount of air to enter the intake manifold for diluting a rich mixture.

Further, the ball seat 60 on the through hole 50 is furnished as a concave in the center of the top surface 34 as shown in FIG. 2, and the spring 64 is replaced with a conical spring.

Referring to FIGS. 1 and 7, the intake end of the body portion 12 of the auxiliary assembly 11 is screwed with a casing member 25 to be loaded with a filter 24; as soon as the vacuum attraction of the intake manifold pulls the valve open, the air outside the casing member 25 will pass through the intake passage 43, the filter 24, the valve and the outer conduit to enter the intake manifold.

Referring to FIG. 9 again, the auxiliary assembly 11 comprises two valves 15 and 18; the valve 15 has a structure as shown in FIG. 7, in which the valve 15 is mounted in a separate body portion 12; the intake end is connected with a separate casing member 25 (including a filter 24), while the other end thereof is connected with a fixing seat of a connecting member, which is connected with the intake manifold through a joint. The low pressure valve 18 is mounted in another separate body portion 12; the intake end thereof is connected with a separate casing member 25 (including a filter 24), while the other end thereof is connected with a fixing seat of a connecting member. When the vacuum attraction of the intake manifold is varied, a suitable amount of air through air flow dimensions of the two valves 15 and 18 will enter the intake manifold.

In a conventional carburetor type of engine, the air-fuel ratio is usually much higher during running, and therefore the engine would exhaust a waste gas containing a high CO, which results in air pollution; then, the car engine has been improved with a fuel injected engine, or a multi-point fuel injected engine, etc,; the object of the aforesaid improvements is to improve the combustion rate in the cylinder of an engine; in fact, such improvement is limited. When a cold engine is started, the throttle valve should be opened wider so as to have very rich mixture; air should enter the carburetor quickly to speed up the vaporization; the engine will be started easily to have a quick idle. In that condition, the mixture must be rich (at about 9:1 in terms of air-fuel ratio). To start an engine, the choke system of a carburetor is usually controlled manually to let a small amount of air pass; the intake manifold can generate a very low pressure (a high vacuum attraction) so as to have the main nozzle spray more fuel for supplying sufficient mixture for the engine to run. As soon as the temperature of an engine rises, the choke valve should be pushed back without choking effect so as to prevent the carburetor from supplying very rich mixture, which may result in air pollution or other problems. Such problem (to supply very rich mixture) has been replaced with an automatic choke system.

When an engine is started, and idling, the throttle valve can supply a mixture through an idle system; the throttle is only slightly opened, and only a small amount of air can pass through the air horn of the carburetor; the air speed is low, and very little vacuum develops in the intake manifold. The almost closed throttle valve can supply a small amount of air (the air-fuel ratio is about 12:1), but the mixture is still rich. When the throttle is opened slightly, the edge of the throttle valve moves past the low-speed port and the idle port in the side of the air horn. Additional fuel is thus fed into the intake manifold through the low-speed port, and then fuel mixes with the additional air moving past the slightly opened throttle valve; it provides sufficient mixture richness for part-throttle low-speed operation. When the throttle valve is slightly opened for medium speed operation, the mixture further leans out to about 15:1. At higher speeds, the throttle valve is fully opened, and the most fuel will flow past the main fuel nozzle; the mixture is enriched to about 13:1. To accelerate the engine, the throttle valve is opened quickly to let additional air enter, and the carburetor can provide extra fuel by using an accelerator-pump system. In order to prevent the engine from shaking upon the throttle valve being opened quickly cause by a shortage of fuel, the accelerator-pump system has a pump plunger to provide pressure to spray fuel into the carburetor; in that case, the accelerating would cause a temporary richness to the mixture. During accelerating, the throttle valve is opened immediately; after the throttle valve is closed, the vacuum attraction in the intake manifold will instantly be raised to cause the mercury column to go up ranging from 23 to 25 inches (584 to 625 mm), and then it will return to the normal pressure (from 17 to 22 inches being equal to 432 to 559 mm of the height of the mercury column).

Generally, when an engine runs, different carburetor systems will provide different air-fuel ratios under different operating conditions for the intake manifold. However, the basic designing principle of an engine is to prevent the engine from shaking as a result of insufficient fuel, and therefore the fuel system usually provides a very rich mixture. According to different carburetor systems, it is apparent that all the idle systems have a very rich mixture; as soon as the engine speed increases, the mixture leans out. From about 40 to 60 km/h, the throttle is only partly opened, and both the idle system and the main metering system are supplying air-fuel mixture. At a speed about 60 km or over, the main metering system will supply the mixture; the air-fuel ratio will increase as soon as the speed increases; As soon as the speed is over 90 km, the power system comes into operation; in that case, the throttle is opened wide to lift the metering rod of the carburetor upwards so as to increase the mixture richness.

To supply air-fuel mixture with different carburetor systems, the vacuum of the intake manifold will change upon the throttle valve being opened or closed. The variation instant of the vacuum would directly affect the supplying condition of the carburetor. When the throttle is opened wide, the low pressure (a high vacuum attraction) of the intake manifold will disappear; this allows the spring under the vacuum piston to push the piston upwards, and this motion raises the metering rod so that the smaller diameter of the rod clears the jet; now, more fuel can flow to handle the full-power requirements of the engine. If the throttle valve is opened upon the engine running at a low speed, the low pressure of the intake manifold will disappear, and the flowing time of the fuel out of the low-speed part on the side of the throttle valve will be longer than usual; as a result, the nozzle of the accelerator-pump system and the main fuel nozzle will supply fuel simultaneously to cause a richer mixture. If the engine at a high speed is accelerated, the throttle valve has already been wide enough so that its edge moves well past the low-speed port; now, there is little difference in vacuum between the upper and lower parts of the air horn; and only a small amount of air fuel mixture is discharged from the low-speed port; the fuel is mainly discharged through the main nozzle of the venturi. When the vacuum attraction of the intake manifold is slightly increased, the air will flow faster, and the pressure in the venturi will be lowered; then, more fuel will be discharged from the main nozzle (i.e., the pressure difference being increased). The throttle valve opened partly to fully opened is referred to as the high-speed scope. During accelerating, more fuel will be supplied, but the air-fuel ratio will remain the same.

When an engine is under idle or a constant speed condition, the vacuum attraction of the intake manifold usually ranges from 17 to 22 inches (432 to 559 mm) of the mercury column. When the engine is accelerated from a low speed operation, the low pressure of the intake manifold will disappear at the same instant to have the vacuum attraction reduced to 100 mm or lower indicated in the mercury column. When an engine is running at a constant speed, the intake manifold will be under a low pressure (high vacuum attraction) condition always. In the present invention, the low-pressure valve 18 of the auxiliary assembly 11 can provide a suitable amount of air, without passing through the carburetor, to enter the intake manifold directly to dilute the rich mixture. At the instant of accelerating from a low speed operation, the low-pressure valve 18 will be closed as soon as the low pressure of intake manifold disappears, and then the valve 15 controlled with a low pressure will supply a suitable amount of air so as to dilute the very rich mixture (including the over rich portion) supplied continuously through a low-speed port until the low-speed port is closed, and until the pressure of the intake manifold returns to the low-pressure condition. At the instant of accelerating from a high speed operation, the low pressure of the intake manifold only reduces slightly, and then the change of the valve 18 of the auxiliary assembly 11 will be small, i.e., it can return to its original position instantly so as to dilute the over-rich mixture with valve 18.

When an engine reduces speed from a high or low speed, the throttle valve will be closed instantly from the full open or half open condition; the vacuum attraction of the intake manifold will raise from a range of 17–22 inches (432 to 559 mm) to a range of 23 to 25 inches (584 to 635 mm) of the mercury column. At the instant of the throttle valve being closed, the fuel jetted out of the main fuel nozzle would have a longer time than usual; during the intake manifold under the low-pressure instant, the low-speed port will suppply fuel quickly to cause an instant over-rich fuel; in other words, the moment of releasing the accelerator will cause the intake manifold to have an extra low pressure to result in an over-rich fuel.

The auxiliary assembly 11 of the present invention is designed and used for improving the over-rich fuel by supplying a suitable amount of fresh air through the valves 15 and 18 of the auxiliary assembly 11, without passing through the carburetor, to enter the intake manifold so as to lean out the over-rich mixture. During the moment of a car starting, or accelerating at a low speed, the vacuum attraction of the intake manifold is low, and suitable amount of fresh air will enter the valve 15 to dilute the over-rich mixture (including the original mixture diluted). At the moment of releasing the accelerator, a very low pressure will exist to cause the valve 18 to be opened fully so as to dilute the over-rich mixture.

Referring to FIGS. 1, 2, 6 to 8, the intake manifold of an engine is in a condition having no pressure before the engine is started; the valve ball 38 (or 58) of the valve 15 is in close contact/with the conic surface 37 (or ball seat 54) as a result of the spring 39 (or 64) pushing against the same, The valve body 28 (or valve ball 53) will also be pushed with the spring 14 to be in close contact with the conic surface 17 (or ball seat) of the valve seat 16 (or 55).

Figure 5:
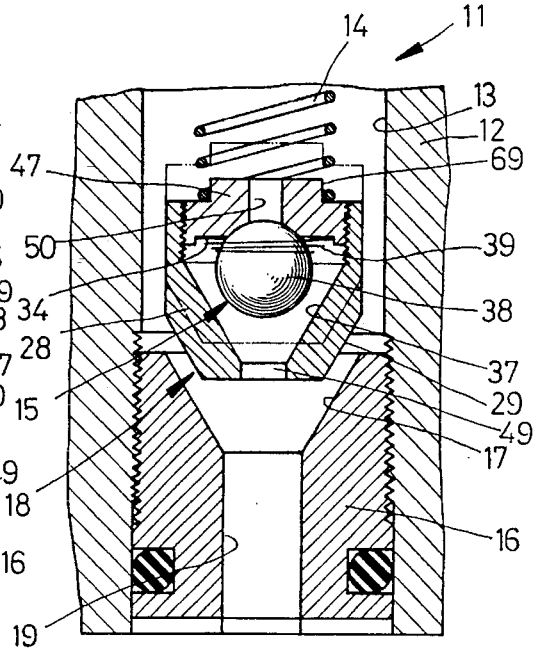
FIG. 5 is a fragmental section view of the present invention, showing the valve operation under the highest vacuum attraction condition of the intake manifold.

Referring to FIGS. 3 to 5 again, when an engine runs in idle, constant speed an accelerating condition, the mercury column of a tester is usually at a height ranging from 17 to 22 (432 to 559 mm), and the valve 15 of the auxiliary assembly 11 will be closed because of the high vacuum attraction, but such high vacuum attraction can cause the valve 18 to open so as to let a suitable amount of air flow past a space between the valve surface 29 of the valve body 28 and the conic surface 17 of the valve seat 16 as shown in FIG. 5. When an engine is accelerated at a low speed, the low pressure of the intake manifold may disappear instantly because of the throttle valve being opened instantly, and then the vacuum attraction of the intake manifold would be be lowered to 100 mm or lower as indicated with the mercury column; then, the spring 14 with a high elastic modulus will push the valve surface 29 of the valve body 28 to become in close contact with the conic surface 17 of the valve seat 16 (as shown in FIG. 3). The low vacuum attraction of the intake manifold will let a suitable mount of air enter the intake manifold through the valve 15 as a result of the function of the spring 39 (a lower elastic modulus spring) so as to dilute the over-rich mixture ( including the over-rich portion supplied originally) entered through the low-speed port until the low-speed port is closed. When the pressure of the intake manifold is reduced rapidly to a low pressure condition, the valve ball 38 of valve 15 will be in close contact with the ball seat 45 of the valve seat 47 (as shown in FIG. 4) as a result of a high vacuum attraction. The valve 18 continues to supply a suitable amount of air (as shown in FIG. 5); at the instant of the throttle valve being opened, and the low pressure of the intake manifold disappearing, the valve 15 will supply a suitable amount of air. The low pressure of the intake manifold will, after disappearing instantly, be restored soon (the vacuum attraction being shown at a height ranging from 17 to 22 inches of the mercury column). During the instant of the throttle valve being closed, the intake manifold will generate a super-low pressure (the vacuum attraction being shown at a height ranging from 23 to 25 inches of the mercury column) to cause the fuel to be over-rich. Such an super-low pressure would cause the air flow dimension of the low-pressure valve 18 to increase (as shown in FIG. 5) so as to supply sufficient air flow to enter the intake manifold for diluting the over-rich mixture; after a very short moment, the low pressure of the intake manifold will return to the normal value.

The auxiliary assembly 11 of the present invention not only can be installed in the vent pipe of the crankcase of an engine, but also can be installed in the intake manifold of different engines so as to supply a suitable amount of air through the two valves 15 and 18 for diluting over rich mixture. If the auxiliary assembly 11 is mounted in the intake manifold of a fuel injected engine, the vacuum will vary upon the engine running so as to supply a suitable amount of fresh air into the intake manifold to provide a complete combustion in the cylinder. The value of an oxygen content sensor in the waste-exhausting pipe can be used as a standard for controlling the fuel out of the nozzle in a cylinder so as to improve the combustion efficiency of a cylinder.

According to the description for the aforesaid embodiment of the present invention, the features and the structure of the present invention have been disclosed completely; it is apparent that the present invention is a novel improvement for an engine, and it is never shown and anticipated by any one because of its unique structure.

I claim:

1. An auxiliary air intake valve assembly for increasing the combustion efficiency of an engine having an intake manifold comprising:

a body portion having a first end connected to the intake manifold, through a connecting terminal a second end connected to a filter, a center hole between said filter and said connecting terminal one end of said center hole having internal threads and a cylindrical surface, said connecting terminal having a through hole and a top side for receiving a spring; a first valve body and a first valve seat located in said center hole, said first valve seat mounted in said center hole by engagement with the internal threads;

a first spring, located in said center hole having a first end pushing against said top side in said center hole, and a second end thereof pushing against a positioning stud of said first valve body so as to bias said first valve body towards said first valve seat;

said first valve body having a first valve surface configured to be in contact with a conic surface of said first valve seat; an inner opening bounded by a conic, second valve seat having an intake hole communicating with the inner opening; a third valve seat attached to said first valve body and facing into said inner opening; a valve ball located in the inner opening; a second spring extending between said third valve seat and said valve ball to bias the valve ball toward said conic second valve seat whereby a low vacuum in the intake manifold above a first predetermined value will open the valve ball enabling air to pass through the first valve body into the intake manifold and when the vacuum reaches a second predetermined value the valve ball engages the third valve seat and the first valve body is displaced away from the first valve seat.

2. An auxiliary air intake valve assembly for improving the combustion efficiency of an engine as claimed in claim 1, wherein said valve ball in said valve body is mounted in place by means of said third valve seat mounted in said first valve body, said third valve seat having a through hole in a center thereof, and having a positioning stud to be engaged by said spring; the third valve seat having a curvature equal to the curvature of said valve ball.

3. An auxiliary air intake valve assembly for improving the combustion efficiency of an engine as claimed in claim 1, wherein said first valve seat and said first valve body each have mating conic surfaces.

4. The auxiliary air intake valve of claim 2 wherein the second spring comprises a generally conical compression coil spring having smaller diameter coils in contact with the valve ball and larger diameter coils in contact with the third valve seat.

5. The auxiliary air intake valve of claim 2 wherein the first spring comprises a generally cylindrical compression coil spring.

6. An auxiliary air intake valve assembly for improving the combustion efficiency of an engine having an intake manifold comprising:

a body portion, having a first end with a connecting terminal connected with the intake manifold a second end of said body portion connected with a casing member having a filter; a passage between said casing member and said connecting terminal having two center holes one end of each of said two center holes having inner threads and cylindrical surfaces respectively, other ends thereof having through holes; a valve located in each of said center holes, each valve including a spring, a valve ball and a valve seat; one of said springs having a lower elastic modulus, than the other of said springs; outer surfaces of said valve seats having threads, a groove and an O-ring located in said groove, a center of each of said valve seats having an intake passage with a ball seat each of said valve balls being biased by one of said springs towards said ball seat of said valve seat.

7. An auxiliary air intake valve assembly for improving the combustion efficiency of an engine as claimed in claim 6, wherein said cylindrical portion of said center hole having said valve with the higher elastic modulus spring is longer than the cylindrical portion of the other of said center holes.

8. An auxiliary air intake valve assembly for improving the combustion efficiency of an engine as claimed in claim 6, further comprising a ball valve seat formed in a center of it top surface of said one of said center holes having the spring with the lower elastic modules for engagement by said valve ball.

9. An auxiliary air intake valve assembly for improving the combustion efficiency of an engine as claimed in claim 8, wherein said ball valve seat comprises a concave surface having a through hole and located in center of said top surface.

10. An auxiliary air intake valve assembly for improving the combustion efficiency of an engine as claimed in claim 6, wherein said body portion comprises two casing members each having a filter respectively on intake ends thereof.

* * * * *